US012590552B2

(12) United States Patent
Meers

(10) Patent No.: US 12,590,552 B2
(45) Date of Patent: Mar. 31, 2026

(54) GREASE DISPENSING SYSTEM

(71) Applicant: OxRock Pty Ltd, Banksmeadow (AU)

(72) Inventor: Barry Meers, Banksmeadow (AU)

(73) Assignee: OXROCK PTY LTD, Banksmeadow (AU)

( * ) Notice: Subject to any disclaimer, the term of this patent is extended or adjusted under 35 U.S.C. 154(b) by 0 days.

(21) Appl. No.: 18/941,642

(22) Filed: Nov. 8, 2024

(65) Prior Publication Data

US 2026/0002456 A1 Jan. 1, 2026

(30) Foreign Application Priority Data

Jun. 26, 2024 (AU) ..... 2024204381

(51) Int. Cl.
*F01M 11/04* (2006.01)
*F01M 11/02* (2006.01)

(52) U.S. Cl.
CPC ..... *F01M 11/04* (2013.01); *F01M 11/02* (2013.01)

(58) Field of Classification Search
CPC ..... F16N 21/00; F16N 3/12; F01M 11/04
USPC ..... 184/105.2
See application file for complete search history.

(56) References Cited

U.S. PATENT DOCUMENTS

| | | | | |
|---|---|---|---|---|
| 1,168,478 | A * | 1/1916 | Carter | F01M 11/04 184/92 |
| 5,044,471 | A * | 9/1991 | Machek | F16N 3/12 222/326 |
| 9,297,498 | B1 * | 3/2016 | Kuntzelman | F16N 3/12 |
| 11,292,026 | B2 * | 4/2022 | Lusso | B05C 17/00596 |
| 2020/0078820 | A1 * | 3/2020 | Lusso | F16N 3/12 |

* cited by examiner

*Primary Examiner* — Victoria P Augustine
*Assistant Examiner* — Mark K Buse
(74) *Attorney, Agent, or Firm* — INNOVATION CAPITAL LAW GROUP, LLP; Vic Lin

(57) ABSTRACT

The grease dispensing system comprises a grease gun machine with a barrel and a threaded plug at its distal end, a grease cartridge configured to fit within the barrel and defining a capped tube with a nozzle having external threading, and an adapter interfacing the threaded plug and nozzle. The adapter includes a smaller connector with internal threading for engagement with the nozzle and a larger connector that fluidly connects to the smaller connector and threads to the plug.

12 Claims, 5 Drawing Sheets

GREASE DISPENSING SYSTEM

FIELD OF THE INVENTION

The present invention relates to the field of lubrication systems, specifically to grease dispensing systems. More particularly, it concerns a grease gun system that includes a grease gun machine, a grease cartridge with external threading, and an adapter configured to interface the components, providing efficient and clean grease application with a visual indicator for monitoring the grease level.

BACKGROUND

Grease gun cartridges are widely used in various mechanical and industrial applications for the lubrication of machinery components. These cartridges typically comprise a cylindrical tube filled with grease, which is sealed at one end with a tear-off plastic tab. To use these cartridges, the tear-off plastic tab is removed to expose the grease at one end of the tube. The exposed end is then inserted into the barrel of a syringe-like dispenser equipped with a plunger. This dispenser, along with the grease cartridge, is subsequently inserted into a grease gun machine.

This traditional method of loading and using grease gun cartridges has several notable disadvantages. Removing the tear-off plastic tab can be messy and cumbersome, often resulting in grease spillage and contamination. This process can also be time-consuming, especially when working in environments where quick and efficient lubrication is crucial. Furthermore, the insertion of the grease cartridge into the barrel of the dispenser and then into the grease gun machine can be awkward and challenging, particularly if the components do not align properly.

The conventional grease gun cartridges also pose environmental concerns. The tear-off plastic tabs and partially emptied cartridges contribute to waste, as it is often difficult to use all the grease within the cartridge. Additionally, the plastic tabs and grease remnants can create disposal issues and potential hazards.

The typical plunger mechanism in these systems can sometimes fail to expel the grease evenly, leading to air locks and incomplete dispensing of the grease. This inefficiency not only wastes grease but also compromises the effectiveness of the lubrication process. Users frequently experience frustration with the traditional pull-tab cartridges, which are messy to open and can leave the grease gun unusable if not loaded correctly.

Moreover, the design of conventional cartridges does not provide an easy method to visually check the remaining amount of grease. Users often have to guess how much grease is left, which can lead to either running out of grease unexpectedly or discarding a cartridge that still contains usable grease.

It is to be understood that, if any prior art information is referred to herein, such reference does not constitute an admission that the information forms part of the common general knowledge in the art, in Australia or any other country.

SUMMARY OF THE DISCLOSURE

The described system is designed for efficiently dispensing grease and comprises a grease gun machine, a grease cartridge, and an adapter for interfacing these components. The grease gun machine defines a barrel with a threaded plug at its distal end. The grease cartridge is designed to fit into the barrel and includes a capped tube with a nozzle protruding from one end, the nozzle having external threading. The adapter is configured to interface the threaded plug and the nozzle, featuring a smaller connector with internal threading to fit the nozzle and a larger connector fluidly interfacing the smaller connector, with threading to fit the threaded plug.

Optionally, the smaller connector of the adapter can define an external nut profile, which can be a hex nut profile, allowing for easy engagement with standard tools. Additionally, the system can include a drive extension socket wrench that is configured for insertion along the barrel to engage the external nut profile, enabling the user to turn the larger connector relative to the threaded plug for secure connection.

The larger connector of the adapter can have external threading, and the adapter may include a funnelled section at the exterior threading to minimise residual grease space. Alternatively, the larger connector may have internal threading, providing versatility depending on the specific configuration of the grease gun machine.

For enhanced functionality, the system can feature a first adapter with a larger connector having external threading and a second adapter with internal threading, both defining consistent smaller connector interior diameters to ensure compatibility with various grease gun machines.

The grease cartridge itself can be equipped with a handleless plunger that interfaces with the open end of the capped tube, which progresses along the tube as grease is dispensed, serving as a visual indicator of the remaining grease.

The adapter can define an interior threaded section at the smaller connector, a central delivery passage with a smaller interior diameter than the interior threaded section, and a funnelled section reducing in diameter from the interior threaded section to the central delivery passage. The smaller connector may have a thread with a nominal diameter of 20 millimetres (M20), a pitch of 2.5 millimetres, and the thread extending continuously along the smaller connector for 10 millimetres.

This system offers significant advantages, such as no bleeding required, cleaner operation, and faster application, reducing mess and increasing efficiency. The environmentally friendly design ensures that cartridges are fully emptied, minimising waste. The ability to visually check the grease level through the plunger position enhances user convenience, and the system avoids common issues like leakage and air locking, ensuring a seamless greasing process.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
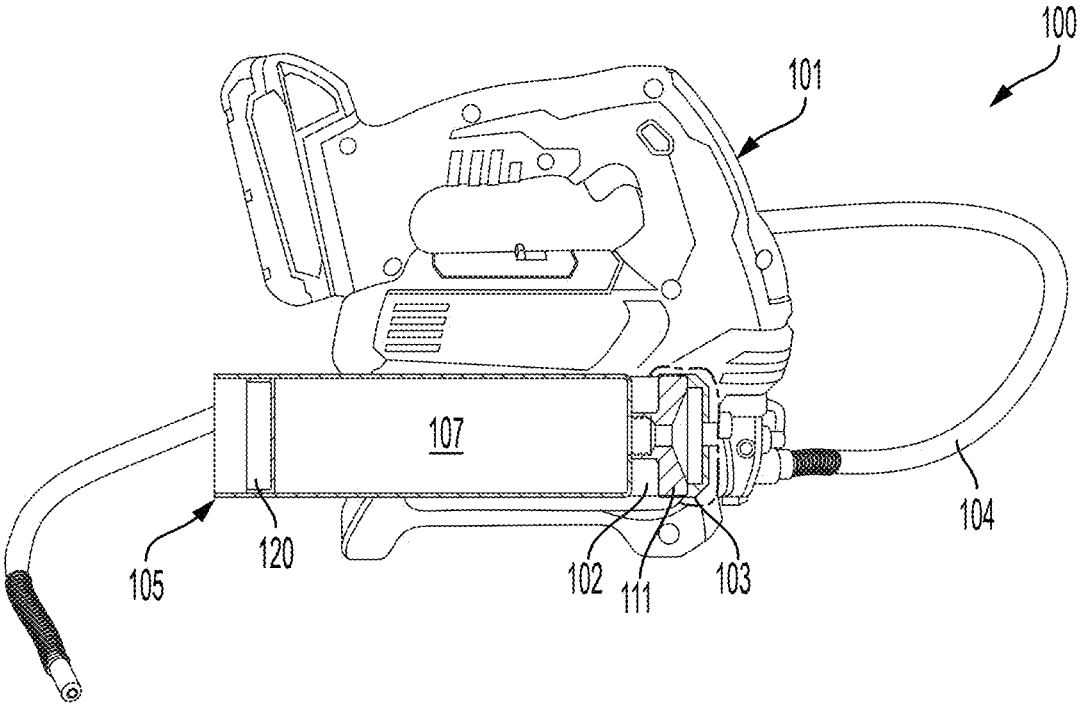
FIG. 1 shows a greasing system in accordance with an embodiment.

FIG. 1 shows a system 100 comprising a grease gun machine 101 defining a barrel 102 and a threaded plug 103 at a distal end of the barrel 102. In the embodiment shown, the grease gun machine is a portable handheld battery-operated grease gun machine with an internal motorised pump which delivers grease via a delivery hose 104.

Figure 5:
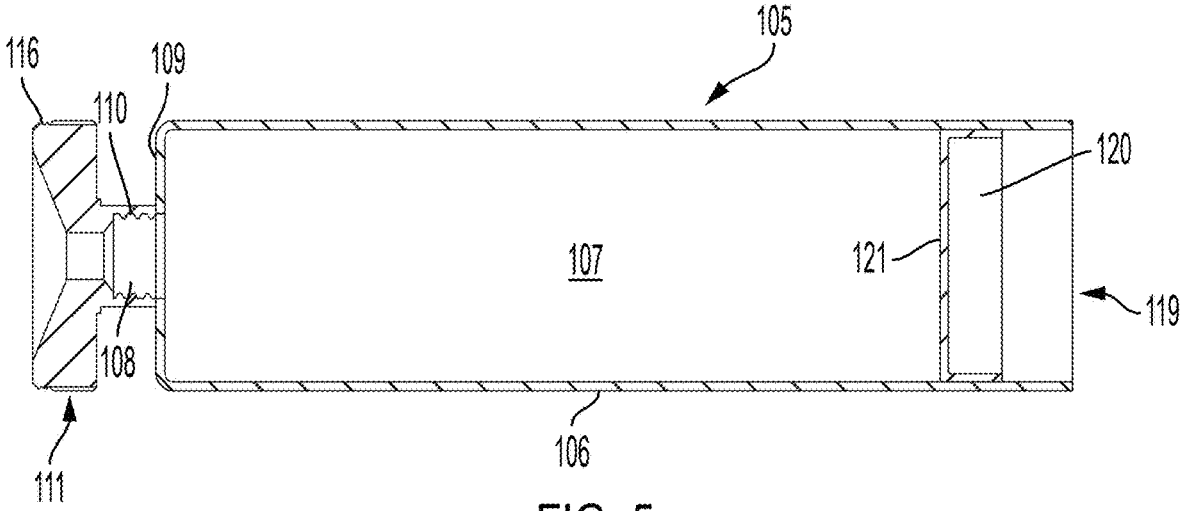
FIG. 5 shows a cross-sectional view of the adapter interfacing a grease gun cartridge of the system.
Figure 6:
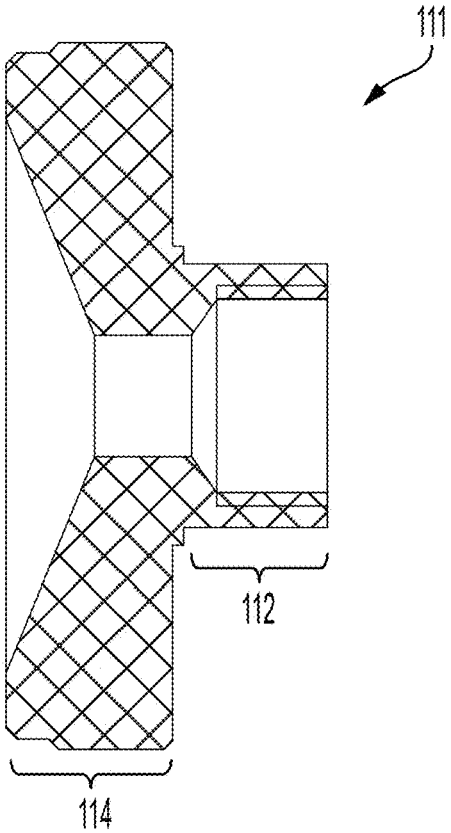
FIG. 6 shows exemplary dimensions of the adapter of FIG. 3.

The system 100 further comprises a grease cartridge 105 configured to fit into the barrel 102. Preferably, the grease cartridge 105 has a 500 g capacity. As best shown in FIG. 5, the grease cartridge 105 is a closed-end or capped tube 106 defining an interior 107 and a nozzle 108 protruding from an end wall 109 of the tube 106. The nozzle 108 may have a diameter of less than one-third that of the tube 106. For example, the tube 106 may have a diameter of over 60 mm, such as approximately 63 mm, whereas the nozzle 108 may have an exterior diameter of approximately 20 mm. The nozzle 108 defines exterior threading 110. The grease cartridge 105 may be designed for disposal or recycling after use and may be made of plastic or similar material.

The system 100 further comprises an adapter 111, typically made of metal. The adapter 111 is configured to interface with the threaded plug 103 of the grease gun machine 101 and the threaded nozzle 108 of the grease cartridge 105. The adapter 111 defines a smaller connector 112 which has internal threading 113 configured to fit the external threading 110 of the nozzle 108 of the grease cartridge 105. Preferably, the smaller connector has a thread with a nominal diameter of 20 millimetres (M20), a pitch of 2.5 millimetres, and the thread extends continuously along the smaller connector for 10 millimetres.

The adapter 111 further defines a larger connector 114 fluidly interfacing with the smaller connector 112, such as through a central delivery passage 115, and which has threading 116 configured to fit the threaded plug 103 of the grease gun machine 101.

Figure 7:
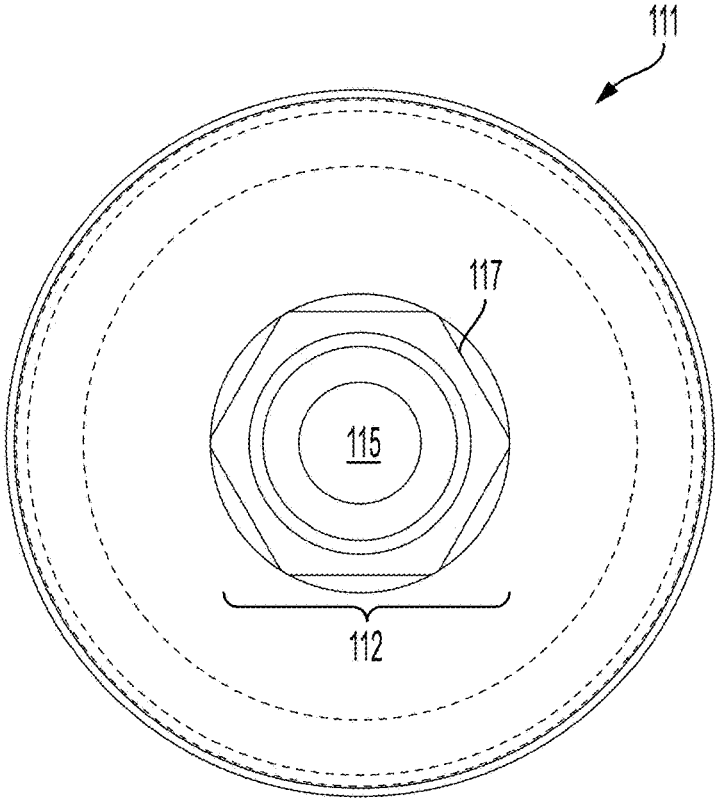
FIG. 7 shows a front view of the adapter.
Figure 8:
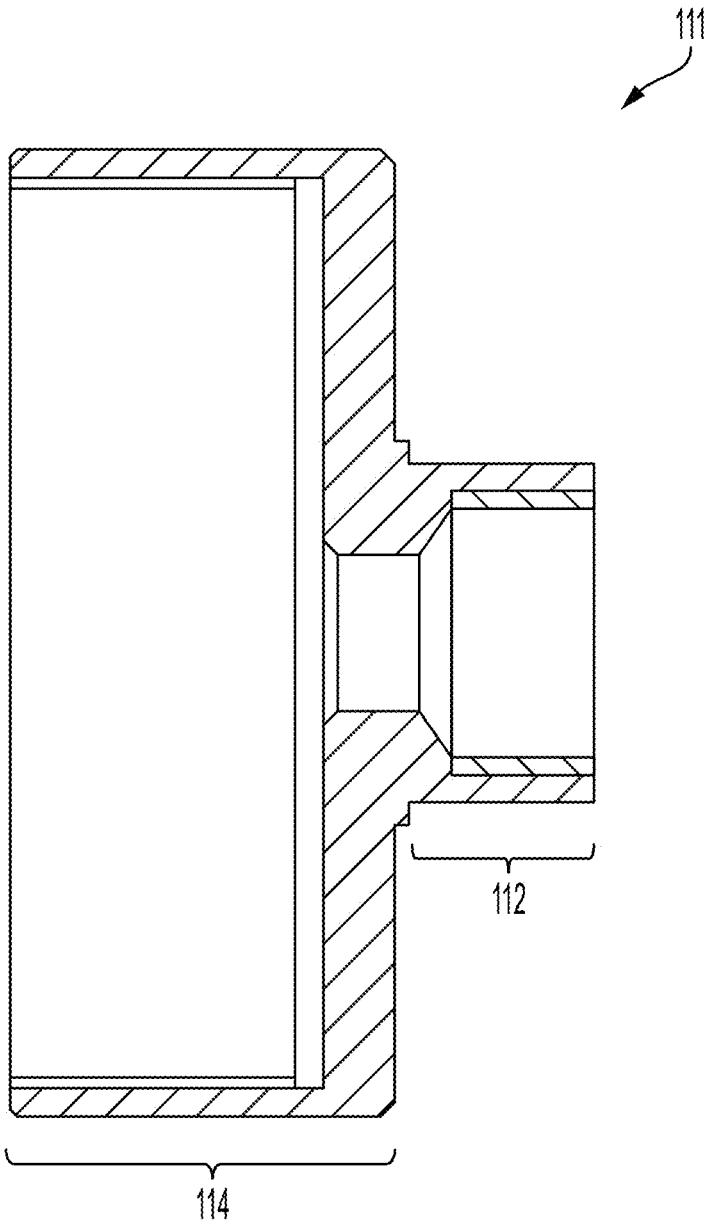
FIG. 8 shows exemplary dimensions of the adapter of FIG. 4.

With reference to FIG. 7, the smaller connector 112 may define an exterior nut profile 117, which is preferably a hex nut profile. Installation of the adapter 111 may comprise engaging the nut profile 117 with a drive extension socket wrench (not shown) inserted along the barrel 102 to turn the larger connector 114 relative to the threaded plug 103 to connect or disconnect the adapter 111 and the threaded plug 103.

Figure 2:
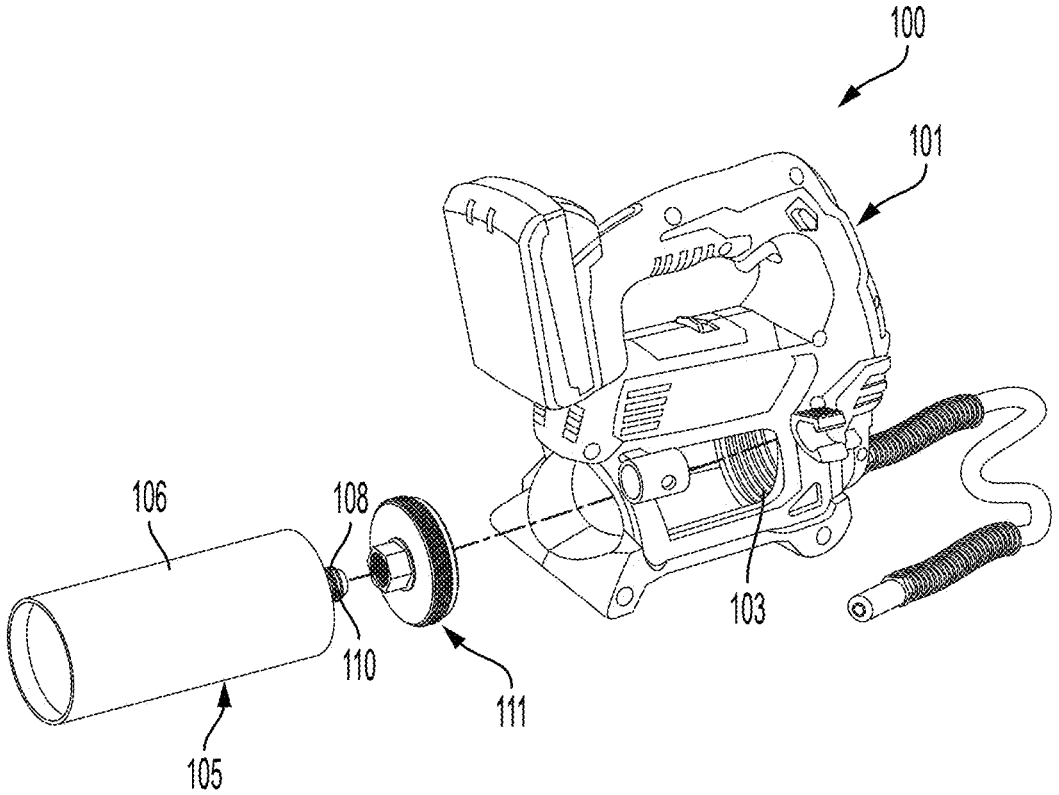
FIG. 2 shows a disassembled view of the system.
Figure 3:
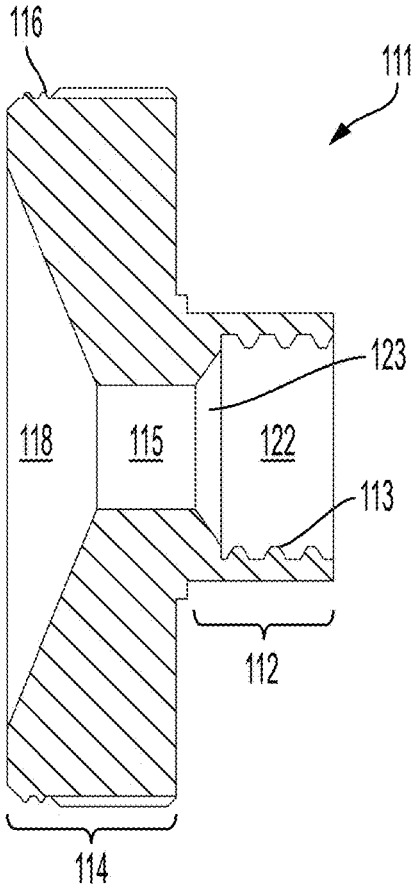
FIG. 3 shows a cross-sectional view of an adapter of the system in accordance with a first embodiment.

FIG. 3 shows an embodiment wherein the larger connector 114 has external threading 116 and which may be used in the manner shown in FIGS. 1 and 2 to engage an internally threaded plug 103 of the grease gun 101. The external screw thread 116 preferably has a major diameter of 64 millimetres, a pitch of 1.5 millimetres, and a full thread length of 11 millimetres.

In accordance with this embodiment, the adapter 111 may have a funnelled section 118 gradually increasing in diameter from the central delivery passage 115, which minimises the space for residual grease.

Figure 4:
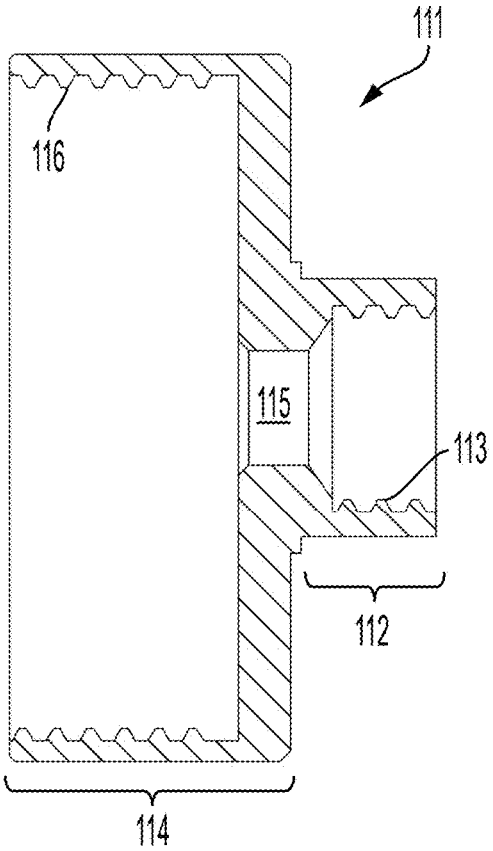
FIG. 4 shows a cross-sectional view of an adapter of the system in accordance with a further embodiment.
Figure 9:
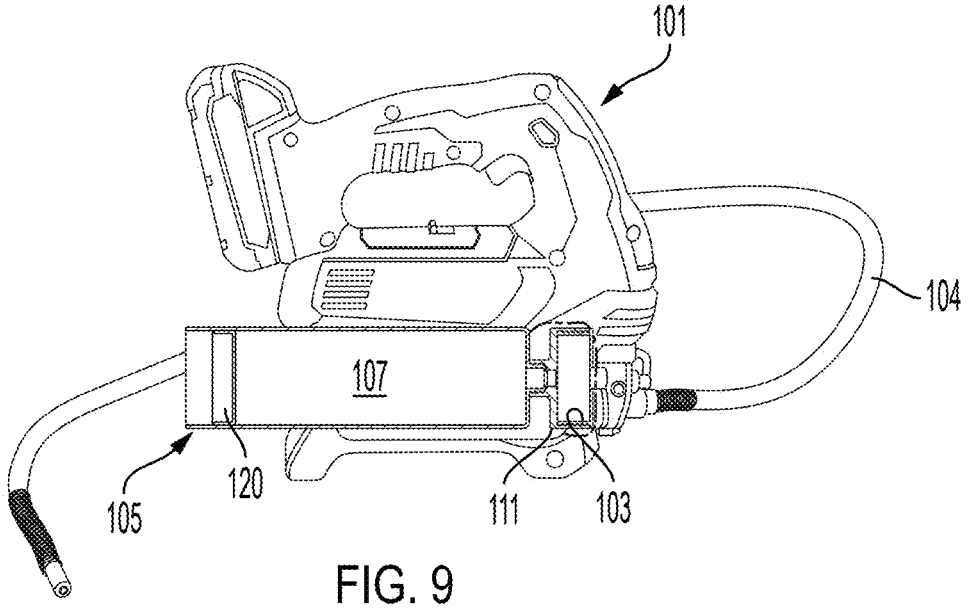
FIG. 9 shows a greasing system in accordance with the further embodiment.
Figure 10:
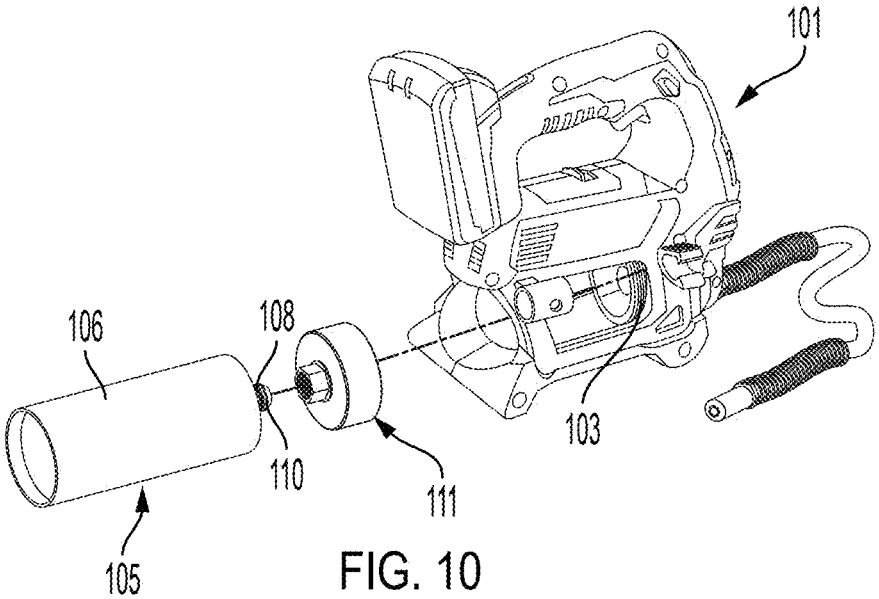
FIG. 10 shows a disassembled view of the system in accordance with the further embodiment.
Figure 11:
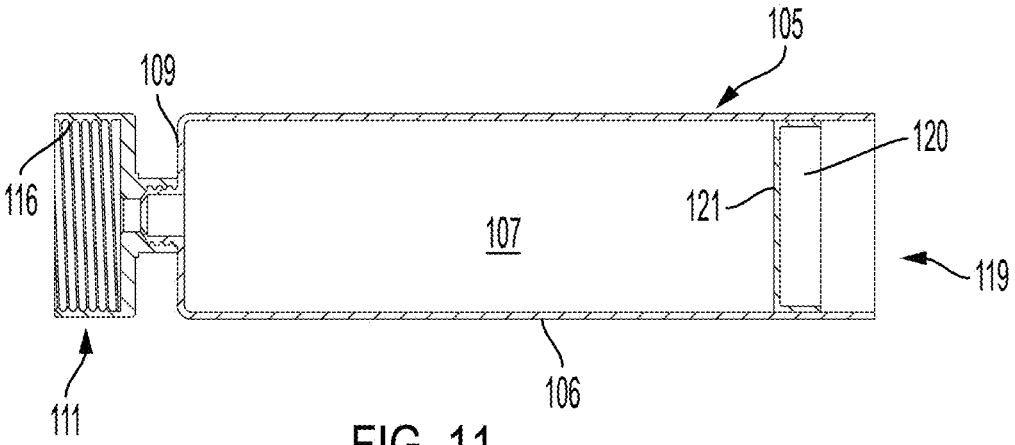
FIG. 11 shows a cross-sectional view of the adapter interfacing a grease gun cartridge of the system in accordance with the further embodiment.

FIG. 4 shows an embodiment wherein the larger connector 114 has internal threading 116 and which may be used in the manner shown in FIGS. 9 and 11 to engage an externally threaded plug 103 of the grease gun 101. The internal screw thread 116 preferably has a major diameter of 64 millimetres, a pitch of 1.5 millimetres, and a full thread length of 20 millimetres.

In embodiments, the system 100 comprises both types of adapters shown in FIGS. 3 and 4 for interchangeable use depending on the grease gun machine 101, which may have different larger connectors 114 suited for the type of grease gun machine 101 but consistent smaller connectors 112 suited for the present grease cartridge 105.

With reference to FIG. 5, a plunger 120 may be slidably retained along the length of the tube 106 through an open end 119 of the tube 106. Preferably, this plunger 120 is without a handle and progresses along the length of the tube 106 towards the nozzle 108 as the grease within the interior 107 of the tube 106 is depleted. The plunger 120 may serve as a visual aid to indicate the amount of grease remaining within the interior 106. The plunger 120 may have a disc 121 which presses flat against the end wall 109 to minimise remnant grease space.

With reference to FIG. 3, the adapter 111 may define an interior threaded section 122, and the central delivery passage 115 has a smaller diameter than the interior threaded section 122. The adapter 111 may define a funnelled section 123 reducing in diameter from the interior threaded section 122 to the central delivery passage 115. The funnelled section 123 constricts the tip of the nozzle 108, thereby ensuring a tight seal between the cartridge 105 and the adapter 111.

To use the system 100, the user begins by preparing the grease gun machine 101 and the adapter 111. The adapter 111 is first inserted into the grease gun machine 101 by aligning the larger connector 114 with the threaded plug 103 at the distal end of the barrel 102. Using a drive extension socket wrench, the user engages the exterior nut profile 117, preferably a hex nut profile, of the smaller connector 112. The wrench is used to rotate the adapter 111, ensuring that the threading 116 of the larger connector 114 securely interfaces with the threaded plug 103 of the grease gun machine 101.

Once the adapter 111 is securely in place, the grease cartridge 105 is prepared for insertion. The user inserts the grease cartridge 105 into the barrel 102 of the grease gun machine 101, nozzle 108 first. The user then rotates the grease cartridge 105, allowing the external threading 110 of the nozzle 108 to engage with the internal threading 113 of the smaller connector 112 of the adapter 111.

With the grease cartridge 105 securely connected, the grease gun machine 101 is then operated. The internal motorised pump of the machine 101 draws grease from the interior 107 of the tube 106 through the nozzle 108, the adapter 111, and out via the delivery hose 104. As grease is dispensed, the handle-less plunger 120 inside the tube 106 is drawn along its length towards the nozzle 108. This plunger 120, which progresses without requiring a handle, serves as a visual guide to indicate the remaining amount of grease within the tube 106. The disc 121 of the plunger 120 presses flat against the end wall 109, minimising any remnant grease space and ensuring efficient utilisation of the grease cartridge 105.

Once the grease cartridge 105 is depleted, the user unscrews the nozzle 108 from the internal threading 113 of the smaller connector 112 by reversing the rotation. The empty cartridge 105 is then removed from the barrel 102 and can be replaced with a new grease cartridge 105, repeating the process for continued operation.

By following these steps, the user ensures a streamlined and effective method for delivering grease using the grease gun machine 101, grease cartridge 105, and adapter 111, with minimal waste and easy replacement of cartridges.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A system comprising:

a grease gun machine defining a barrel and a threaded plug at a distal end of the barrel;

a grease cartridge configured for fitting into the barrel, the grease cartridge having capped tube and a nozzle protruding from an end wall of the tube, the nozzle having external threading, and an adapter configured for interfacing the threaded plug and the nozzle wherein the adapter comprises a smaller connector which has internal threading and configured to fit the nozzle and a larger connector fluidly interfacing the smaller connector which has threading configured to fit the threaded plug;

wherein the smaller connector defines an external nut profile.

2. The system as claimed in claim 1, wherein the external nut profile is a hex nut profile.

3. The system as claimed in claim 1, wherein the larger connector has external threading.

4. The system as claimed in claim 3, wherein the adapter is funneled at the exterior threading.

5. The system as claimed in claim 3, wherein the larger connector has internal threading.

6. The system as claimed in claim 1, wherein a handle-less plunger interfaces with an open end of the capped tube.

7. The system as claimed in claim 1, wherein the adapter defines an interior threaded section at the smaller connector, a central delivery passage having a smaller interior diameter than the interior threaded section, and a funneled section reducing in diameter from the interior threaded section to the central delivery passage.

8. The system as claimed in claim 1, wherein the smaller connector has a thread with a nominal diameter of 20 millimetres.

9. The system as claimed in claim 8, wherein the pitch of the thread is 2.5 millimetres.

10. The system as claimed in claim 8, wherein the thread extends continuously along the smaller connector for 10 millimetres.

11. A method of using the system as claimed in claim 1, the method comprising:

inserting the grease cartridge into the barrel of the grease gun machine, and interfacing the adapter with the threaded plug of the grease gun machine and the nozzle of the cartridge, wherein the adapter comprises a smaller connector with internal threading configured to fit the nozzle and a larger connector fluidly interfacing the smaller connector, the larger connector having threading configured to fit the threaded plug;

wherein the smaller connector defines an external nut profile.

12. The method as claimed in claim 11, wherein the cartridge comprises a plunger and wherein the plunger is operated without a handle.

* * * * *